United States Patent [19]

Cairns et al.

[11] 4,214,801

[45] Jul. 29, 1980

[54] FUSE HOLDER WITH INSERTION RAMP

[75] Inventors: Thomas M. Cairns, Birmingham; John H. Dewar, Grosse Ile; Emmons F. Sumner, Ann Arbor, all of Mich.

[73] Assignee: Ford Motor Company, Dearborn, Mich.

[21] Appl. No.: 16,579

[22] Filed: Mar. 1, 1979

[51] Int. Cl.[2] ..... H01R 11/22

[52] U.S. Cl. ..... 339/59 R; 339/258 R

[58] Field of Search ..... 339/59, 217 S, 219 F, 339/252 F, 253 F, 258 F, 270 F, 198 R, 176 R

[56] References Cited

U.S. PATENT DOCUMENTS

| | | | |
|---|---|---|---|
| 2,972,727 | 2/1961 | Flanagan | 339/258 F X |
| 3,199,065 | 8/1965 | Thompson | 339/258 F X |
| 3,289,146 | 11/1966 | Tuchel | 339/258 F |
| 3,753,193 | 8/1973 | Teagno | 339/217 S X |
| 3,763,458 | 10/1973 | Taormina | 339/59 R |
| 3,813,637 | 5/1974 | Grebik | 339/59 R |
| 3,874,769 | 4/1975 | Simon | 339/217 S |
| 3,982,805 | 9/1976 | Irie | 339/59 R |
| 4,013,331 | 3/1977 | Kobler | 339/59 R |

*Primary Examiner*—Neil Abrams
*Assistant Examiner*—John S. Brown
*Attorney, Agent, or Firm*—Peter Abolins; Clifford L. Sadler

[57] ABSTRACT

This specification discloses an automobile terminal block for receiving fuses, and electrical connections to various electrical components of the automobile. The terminal block has a passage which has therein a fuse holder mounted within the terminal block. The fuse holder receives the blade contact of a fuse thereby establishing an electrical connection to the fuse. The fuse holder has a spring clip with two prongs spring biased against one another so that a blade contact can be resiliently secured between the two prongs. The fuse holder is inserted into the terminal block and has an opening therein for receiving a protrusion extending into the passage where the fuse holder is inserted thereby securing the fuse holder to the terminal block. The fuse holder has a ramp attached to each of the prongs for facilitating movement of the prongs over the protrusion so that the protrusion does not engage the prongs and stop the fuse holder from moving into the passage.

5 Claims, 7 Drawing Figures

FUSE HOLDER WITH INSERTION RAMP

BACKGROUND OF THE INVENTION (1) Field of the Invention

This invention relates to electrical connectors; and, more particularly, to a terminal block which removably secures various connections.

(2) Prior Art

Automobiles typically have a fuse terminal block which is mounted adjacent the instrument panel or forward fire wall to provide a means for securing fuses and for providing connections to various electrical components of an automobile such as headlights, horns, power seats, power windows and numerous other electrical options which can be customer selected on automobiles.

It is particularly desirable that the components of the terminal block can be easily and quickly assembled. Advantageously, the system should be completely "fool proof" to satisfy the needs of rapid and simple mass production of automobiles as well as repair of any faults in the terminal block or replacement of fuses. Because of the desire of either the assembler or the repairer to use "short cuts" or to otherwise complete the job as quickly as possible without adequate assurance of quality of the completed apparatus, designing a fuse holder has presented problems.

For example, in one known system taught in U.S. Pat. No. 4,097,109, a fuse holder is inserted into a cavity in the terminal block and tines extending at an angle from the sides of the fuse holder engage ledges as the fuse holder is pushed into position. Thus, the fuse holder is held in the terminal block by a ratchet-like mechanism. Experience has shown that the tines used to hold the fuse holder in the terminal block are relatively fragile and can be bent when a sufficient force is applied to the fuse holder and thus either loosen the fuse holder in the terminal block or remove the fuse holder from the terminal block. As a result, it has been found desirable to search for an improved means of inserting and holding the fuse holder within the terminal block. These are some of the problems this invention overcomes.

SUMMARY OF THE INVENTION

This invention recognizes that a fuse holder with a pair of prongs can be secured in a terminal block by receiving a protrusion extending from the terminal block within an opening in the fuse holder. This invention also recognizes that to facilitate insertion of the fuse holder into the passage of the terminal block wherein the protrusion extends, a ramp means is attached to each of the prongs of the fuse holder for facilitating movement of prongs over the protrusion so that the protrusion does not engage the prongs and stop the fuse holder from moving into the passage.

Thus, the assembly of the fuse holder into the terminal block is easily accomplished and the fuse holder is positively held within the terminal block with a relatively strong holding force supplied by the protrusion. It is also particularly advantageous that the ramp can be formed in a progressive die and be an integral part of the fuse holder thereby facilitating fabrication and reducing cost.

DETAILED DESCRIPTION OF THE INVENTION

Figure 1:
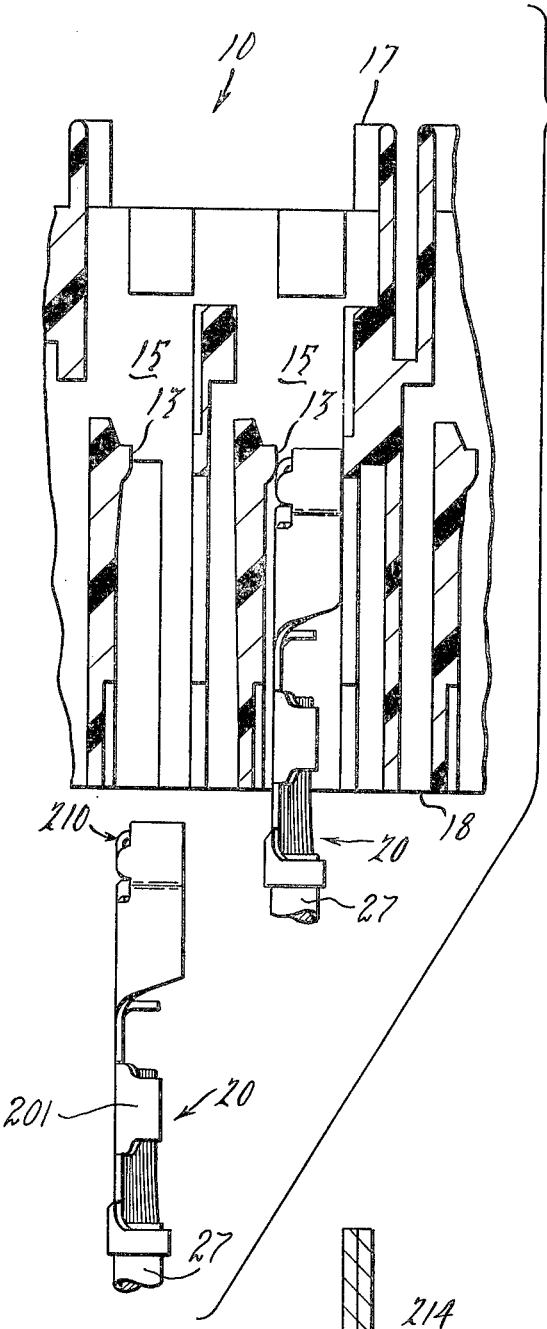
FIG. 1 is a side, partly section view of one fuse holder before insertion into a terminal block and a second fuse holder inserted sufficiently far so the resilient finger of the terminal block is deflected by the ski portion of the ramp of the fuse holder.
Figure 2:
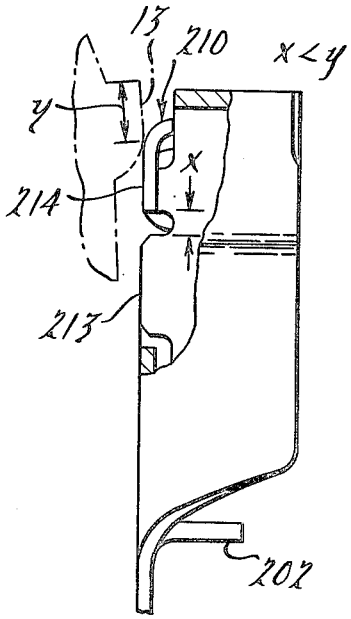
FIG. 2 is an enlarged view, partly broken away, of a fuse holder abutting a protrusion from a resilient finger, the x dimension of the fuse holder separating the ski portion from the sled portion of the ramp being less than the y dimension of the face of the protrusion.
Figure 3:
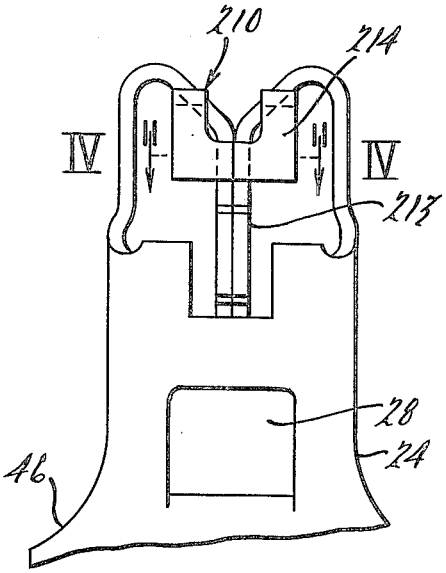
FIG. 3 is a front elevation view of a fuse holder including ramp means with a ski portion and a sled portion in accordance with an embodiment of this invention.
Figure 4:
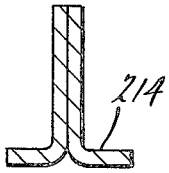
FIG. 4 is a section view taken along line IV—IV of FIG. 3 showing the attachment of the ski portion to the intermediate portion of the fuse holder.
Figure 6:
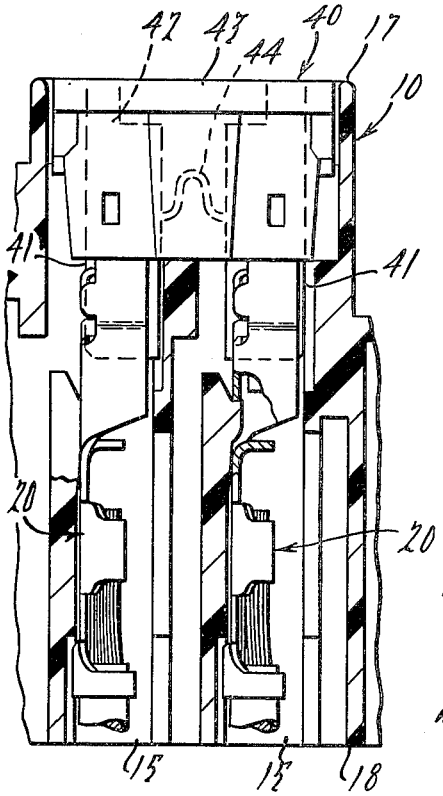
FIG. 6 is a side elevation, partly section, view similar to FIG. 1 with the fuse holders in place in the terminal block and the addition of a fuse.
Figure 7:
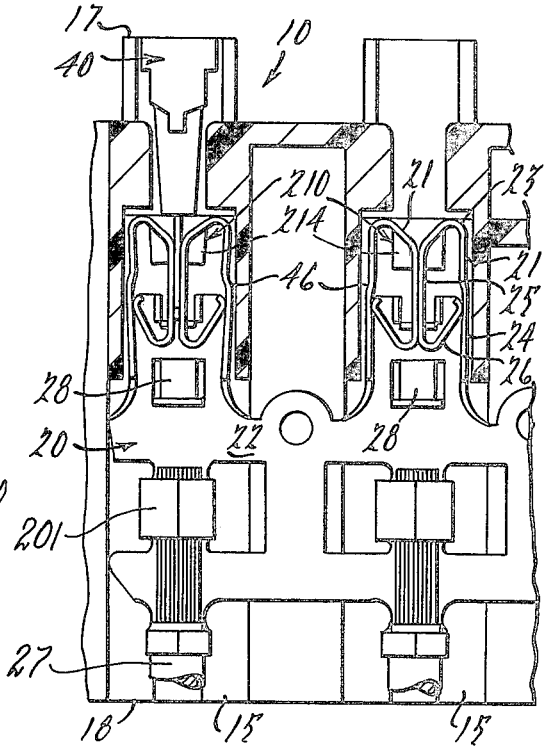
FIG. 7 is a front elevation, partly section, view of the assembly (without the fuse) shown in FIG. 6.

Referring to FIGS. 1, 6 and 7, a terminal block 10 has the general shape of a rectangular solid with a plurality of passages 15 extending therethrough between a front (or top) surface 17 and a rear (or bottom) surface 18. At least some of passages 15 from top surface 17 of terminal block 10 are designed to receive a fuse 40 having a pair of spaced blade contacts 41. Fuse 40 is advantageously a miniature plug-in fuse similar to that described in U.S. Pat. No. 3,909,767 issued Sept. 30, 1975 and assigned to Littlefuse, Inc. At least some of passages 15 are accessible from bottom surface 18 of terminal block 10 and are adapted to receive a fuse holder 20 as shown in FIGS. 2 and 3. Further, various accessory connections can be made from the bottom of terminal block 10 to fuse holder 20 or, in some cases, directly to blade contacts 41 of fuse 40.

Fuse holder 20 has a longitudinally extending bus bar 22 having laterally extending spring clips 23, each having a pair of prongs 21 (FIG. 7). Fuse holder 20 typically has a plurality of spring clips 23 along its length and at least a pair of attaching prongs 201 for connecting to an electrical lead 27. Prongs 21 have an outside portion 24, an intermediate portion 25 and an end portion 26. Between outside portion 24 and intermediate portion 25 there is a fold or bend and there is another fold or bend between intermediate portion 25 and end portion 26. Accordingly, spring clip 23 comprises two prongs 21 which are folded back on themselves twice so that the end portions 26 of each prong 21 bear resiliently against the outside portions 24 and the intermediate portions 25 of the two prongs 21 bear against each other. In use, a blade contact 41 of fuse 40 is held resiliently between intermediate portions 25 of the two prongs 21. Fuse holder 20 also includes an opening 28 associated with each spring clip 23 which acts in cooperation with a portion of terminal block 10 to secure fuse holder 20 in terminal block 10.

Fuse 40 is a relatively small, flat element which includes a flat sheet metal stamping 42 partially situated within a plastic housing 43 (FIG. 6). Stamping 42 includes a fuse element 44, and blade contacts 41 which are a pair of laterally spaced protruding contact elements which are to be received between prongs 21 of a spring clip 23 which is part of fuse holder 20.

Additional description of the above described fuse terminal block assembly is found in the following copending applications filed on even date herewith, the disclosures of which are hereby incorporated by reference: Title of I—Terminal Block With Electrical Connection Means With Connector Location Wall And Locking Finger, Ser. No. 16,469. Title of II—Fuse Holder With Entry Control, Ser. No. 16,468. Title of III—Fuse Terminal Block With Alternative Means For Connecting Two Fuse Blades, Ser. No. 16,474. Title of IV—Terminal Block With Fuse Guards And Identification Surface, Ser. No. 16,473. Title of VIII—Fuse Holder With Insertion Ramp, Ser. No. 16,589.

The invention is directed toward the combination of an opening 28 and a ramp 210 in fuse holder 20 which is designed to receive a protrusion 13 from terminal block 10.

Ramps 210 are aligned with opening 28 in the direction of insertion of fuse holder 20 into terminal block 10 so that the protrusion 13 extending from terminal block 10 into the passage wherein fuse holder 20 is inserted is deflected. If ramp 210 were not present, there is a possibility that protrusion 13 would get hung up on some portion of spring clip 23 thereby either bending fuse holder 20, which may result in establishing improper electrical contact, or breaking protrusion 13 which may result in a loose fuse holder 20 in terminal block 10. In either case, the reliability of electrical connection would be impaired.

Figure 5:
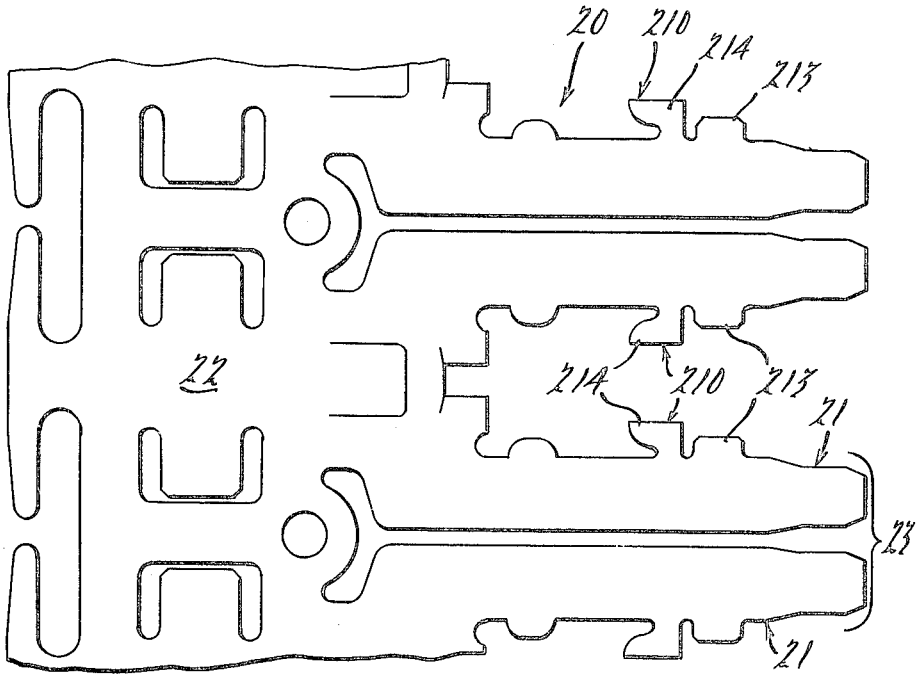
FIG. 5 is a developed view of a fuse holder, before folding, in accordance with an embodiment of this invention.

Fuse holder 20 is made of a sheet metal and is typically formed in a progressive die. A developed view of fuse holder 20, before any folding has taken place, is shown in FIG. 5. As can be appreciated in FIG. 5 as well as FIGS. 1 and 3, ramps 210 include a sled portion 213 and a ski portion 214 which are sufficiently closely spaced so that protrusion 13 cannot enter therebetween and prevent insertion of fuse holder 20 into terminal block 10. That is, as fuse holder 20 enters passage 15, protrusion 13 first rides over ski portion 214 and then sled portion 213 before it finally enters opening 28.

Referring to FIGS. 3 and 7, outside portion 24 of each prong 21 of spring clip 23 has a hip 46 which gives spring clip 23 a smaller width at the top than at the bottom. The two different widths permit a relatively snug fit between the bottom of spring clip 23 and the sides of passage 15 while allowing sufficient clearance between the top of spring clip 23 and the sides of passage 15 to facilitate positioning of a blade contact 41 between the two prongs 21 of spring clip 23.

Various modifications and variations will no doubt occur to those skilled in the various arts to which this invention pertains. For example the particular size and thickness of the ramp may be varied from that described herein. These and all other variations which basically rely on the teachings through which this disclosure has advanced the art are properly considered within the scope of this invention.

We claim:

1. A terminal block and a fuse holder for use in said terminal block in conjunction with blade contacts of a fuse wherein said terminal block has a passage with a movable protrusion extending therein for engaging said fuse holder, said fuse being of a miniature nature with a pair of blade contacts, said fuse holder including a plurality of resilient spring clips each having a pair of opposing prongs, said fuse holder having an opening therein for receiving said protrusion;

said fuse holder having a ramp means attached to at least one of said prongs for facilitating movement of said prongs over said protrusion so that said protrusion slides over said prongs and said fuse holder continues to move into said passage and said protrusion comes to extend into said opening of said fuse holder, the orientation of said spring clips with respect to said movable protrusion being such that said pair of opposing prongs define a blade receiving path therebetween which is in a plane generally parallel to the direction of travel of said movable protrusion;

said ramp means being an integral part of said fuse holder and adjacent the forwardmost portion of said fuse holder which enters said terminal block first, the entire fuse holder assembly being integrally formed from a single metal blank;

each of said pair of opposing prongs having an outside portion, an intermediate portion, and an end portion, there being a fold or bend between the outside portion and the intermediate portion and between the intermediate portion and end portion so that the two prongs are folded back on themselves twice, the end portion of each prong bearing resiliently against the outside portion, and the intermediate portions of the two prongs bearing against each other;

said ramp means being integrally connected to said intermediate portion at a position generally where opposing intermediate portions make contact and extending generally upward toward said bend between said outside and intermediate portions; and said opening being formed in a member extending between opposing ones of said outside portions.

2. A fuse holder as recited in claim 1 wherein said ramp is aligned with said opening in the direction of movement of said fuse holder into said terminal block.

3. A fuse holder as recited in claim 2 wherein said ramp means includes a ski portion and an aligned sled portion, the spacing between said sled and ski portion being sufficiently small so that said protrusion cannot enter therebetween and prevent the insertion of said fuse holder into said terminal block.

4. A fuse holder as recited in claim 2 wherein said ski portion extends out perpendicularly from said intermediate portion toward said outside portion and then extends perpendicularly toward said bend between said intermediate and outside portions, said sled portion comprising adjacent intermediate portions which extend out substantially to the plane of said ski portion, and said ski portion including a tip with a curved surface to facilitate engagement with said protrusion.

5. A fuse holder as recited in claim 1 wherein said spring clip includes a pair of prongs each having an outside portion, an intermediate portion, and an end portion, there being a fold or bend between the outside portion and the intermediate portion and between the intermediate portion and end portion so that the two prongs are folded back on themselves twice, the end portion of each prong bears resiliently against the outside portion, and the intermediate portions of the two prongs bear against each other; said outside portion having a hip means so that width of said spring clip is less at the top than at the bottom thus permitting a relatively snug fit between the bottom of said spring clip and said passage and permitting sufficient clearance between the top of said spring clip and said passage to facilitate positioning of said fuse blade contact between said prongs when said spring clip is positioned in said passage, said hip means having an inflexible fixed width which does not enlarge when a blade contact is positioned in said spring clip.

* * * * *